US007958787B2

(12) United States Patent
Hunter

(10) Patent No.: US 7,958,787 B2
(45) Date of Patent: Jun. 14, 2011

(54) OILFIELD TUBULAR TORQUE WRENCH

(75) Inventor: Douglas A. Hunter, Calgary (CA)

(73) Assignee: Canrig Drilling Technology Ltd., Houston, TX (US)

( * ) Notice: Subject to any disclaimer, the term of this patent is extended or adjusted under 35 U.S.C. 154(b) by 118 days.

(21) Appl. No.: 12/391,980

(22) Filed: Feb. 24, 2009

(65) Prior Publication Data

US 2009/0205442 A1 Aug. 20, 2009

Related U.S. Application Data

(63) Continuation of application No. PCT/CA2006/001388, filed on Aug. 24, 2006.

(51) Int. Cl.
*G01L 5/24* (2006.01)

(52) U.S. Cl. ..... 73/862.21

(58) Field of Classification Search ..... 73/862.21
See application file for complete search history.

(56) References Cited

U.S. PATENT DOCUMENTS

| | | | | |
|---|---|---|---|---|
| 3,693,727 | A * | 9/1972 | Bell | 173/177 |
| 3,768,573 | A | 10/1973 | Jennings | |
| 3,799,009 | A | 3/1974 | Guier | |
| 3,881,375 | A | 5/1975 | Kelly | |
| 3,882,377 | A | 5/1975 | Kelly | |
| 3,961,399 | A | 6/1976 | Boyadjieff | |
| 4,023,449 | A | 5/1977 | Boyadjieff | |

(Continued)

FOREIGN PATENT DOCUMENTS

CA 1014705 8/1977

(Continued)

OTHER PUBLICATIONS

HiPer™ Control System, http://www.weatherford.com/weatherford/groups/public/documents/general/wft008924.pdf, 2005.

(Continued)

*Primary Examiner* — Lisa M Caputo
*Assistant Examiner* — Octavia Davis
(74) *Attorney, Agent, or Firm* — Haynes and Boone, LLP

(57) ABSTRACT

A method for measuring applied torque of a oilfield tubular torque wrench, the oilfield torque wrench being operable to torque a tubular about an axis of rotation and the oilfield torque wrench including a lower tong including a recess through which the axis of rotation passes during operation; an upper tong including a recess, the upper tong being mounted above the lower tong with the recess of the upper tong positioned above the recess of the lower tong so that the axis of rotation passes therethrough; pipe gripping dies in the recesses of the upper tong and the lower tong; a swivel bearing between the upper tong and the lower tong permitting the upper tong and the lower tong to swivel relative to each other while the recesses remain positioned with the axis of rotation passing therethrough; a drive system connected between the upper tong and the lower tong, the drive system being operable to generate a force vector to drive the upper tong and lower tong to swivel on the swivel bearing, the method comprising: determining at least one of (i) the actual radius measurement measured perpendicularly to the force vector and between the force vector and the axis of rotation of the tubular, and (ii) the actual force measurement of that force being applied to torque the connection; and calculating torque based on the at least one measurement. A torque wrench includes systems for measuring actual radius and/or actual force.

19 Claims, 4 Drawing Sheets

U.S. PATENT DOCUMENTS

| | | | | |
|---|---|---|---|---|
| 4,082,017 | A | | 4/1978 | Eckel |
| 4,091,451 | A | | 5/1978 | Weiner et al. |
| 4,125,040 | A | | 11/1978 | True |
| 4,176,436 | A | | 12/1979 | McCombs et al. |
| 4,192,206 | A | | 3/1980 | Schulze-Beckinghausen |
| 4,202,225 | A | | 5/1980 | Sheldon et al. |
| 4,208,775 | A | | 6/1980 | McCombs et al. |
| 4,210,017 | A | | 7/1980 | Motsinger |
| 4,235,566 | A | | 11/1980 | Beeman et al. |
| 4,365,402 | A | | 12/1982 | McCombs et al. |
| 4,386,883 | A | | 6/1983 | Hogan et al. |
| 4,403,898 | A | | 9/1983 | Thompson |
| 4,437,363 | A | | 3/1984 | Haynes |
| 4,444,273 | A | | 4/1984 | Ruby |
| 4,444,421 | A | | 4/1984 | Ahlstone |
| 4,470,740 | A | | 9/1984 | Frias |
| 4,474,520 | A | | 10/1984 | Buckner et al. |
| 4,494,899 | A | | 1/1985 | Hoang et al. |
| 4,495,840 | A | | 1/1985 | Freitag et al. |
| 4,515,045 | A | | 5/1985 | Gnatchenko et al. |
| 4,552,041 | A | | 11/1985 | Coyle, Sr. |
| 4,567,779 | A | | 2/1986 | Byrne |
| 4,567,952 | A | | 2/1986 | Lemaire et al. |
| 4,574,664 | A | | 3/1986 | Curry |
| 4,592,125 | A | | 6/1986 | Skene |
| 4,603,464 | A | | 8/1986 | Smith, Jr. et al. |
| 4,688,453 | A | | 8/1987 | Schulze-Beckinghausen |
| 4,696,207 | A | | 9/1987 | Boyadjieff |
| 4,700,787 | A | | 10/1987 | Buck et al. |
| 4,709,766 | A | | 12/1987 | Boyadjieff |
| 4,725,179 | A | | 2/1988 | Woolslayer et al. |
| 4,730,254 | A | | 3/1988 | Voden, Jr. |
| 4,738,145 | A | | 4/1988 | Vincent et al. |
| 4,739,681 | A | | 4/1988 | Pietras |
| 4,765,401 | A | | 8/1988 | Boyadjieff |
| 4,808,064 | A | | 2/1989 | Bartholet |
| 4,843,945 | A | | 7/1989 | Dinsdale |
| 4,924,954 | A | | 5/1990 | Mead |
| 4,941,362 | A | | 7/1990 | Tambini |
| 4,981,180 | A | | 1/1991 | Price |
| 5,036,927 | A | | 8/1991 | Willis |
| 5,050,691 | A | | 9/1991 | Moses |
| 5,099,725 | A | * | 3/1992 | Bouligny et al. ..... 81/57.34 |
| 5,172,613 | A | * | 12/1992 | Wesch, Jr. ..... 81/57.33 |
| 5,291,808 | A | | 3/1994 | Buck |
| 5,297,833 | A | | 3/1994 | Willis et al. |
| 5,402,688 | A | | 4/1995 | Okada et al. |
| 5,435,213 | A | | 7/1995 | Buck |
| 5,509,316 | A | | 4/1996 | Hall |
| 5,855,002 | A | | 12/1998 | Armstrong |
| 6,003,412 | A | | 12/1999 | Dlask et al. |
| 6,012,360 | A | | 1/2000 | Concha |
| RE36,631 | E | | 3/2000 | Tanabe et al. |
| 6,047,775 | A | | 4/2000 | Mock |
| 6,070,500 | A | | 6/2000 | Dlask et al. |
| 6,079,925 | A | | 6/2000 | Morgan et al. |
| 6,082,224 | A | * | 7/2000 | McDaniels et al. ..... 81/57.15 |
| 6,082,225 | A | * | 7/2000 | Richardson ..... 81/57.16 |
| 6,206,096 | B1 | | 3/2001 | Belik |
| 6,213,216 | B1 | | 4/2001 | Rogers |
| 6,237,445 | B1 | * | 5/2001 | Wesch, Jr. ..... 81/57.18 |
| 6,263,763 | B1 | * | 7/2001 | Feigel et al. ..... 81/57.34 |
| 6,311,789 | B1 | | 11/2001 | Saxman |
| 6,314,411 | B1 | | 11/2001 | Armstrong |
| 6,374,706 | B1 | | 4/2002 | Newman |
| 6,385,837 | B1 | | 5/2002 | Murakami et al. |
| 6,505,531 | B2 | | 1/2003 | Stogner |
| 6,532,648 | B2 | | 3/2003 | Murakami et al. |
| 6,533,519 | B1 | | 3/2003 | Tolmon et al. |
| 6,634,259 | B2 | | 10/2003 | Castille |
| 6,715,569 | B1 | | 4/2004 | Rogers |
| 6,752,044 | B2 | | 6/2004 | Hawkins, III |
| 6,814,149 | B2 | | 11/2004 | Liess et al. |
| 6,896,055 | B2 | | 5/2005 | Koithan |
| 6,966,385 | B2 | | 11/2005 | Hemphill et al. |
| 7,000,502 | B2 | | 2/2006 | Belik |
| 7,028,585 | B2 | | 4/2006 | Pietras et al. |
| 7,036,396 | B2 | | 5/2006 | Moe et al. |
| 7,062,991 | B1 | | 6/2006 | West et al. |
| 7,100,698 | B2 | | 9/2006 | Kracik et al. |
| 7,117,938 | B2 | | 10/2006 | Hamilton et al. |
| 7,178,612 | B2 | | 2/2007 | Belik |
| 7,191,686 | B1 | | 3/2007 | Angelle et al. |
| 7,249,639 | B2 | | 7/2007 | Belik |
| 7,264,050 | B2 | | 9/2007 | Koithan et al. |
| 7,322,406 | B2 | | 1/2008 | Wiggins et al. |
| 7,435,924 | B2 | * | 10/2008 | Schmitt-Walter et al. . 219/86.33 |
| 7,455,128 | B2 | | 11/2008 | Belik |
| 2004/0237726 | A1 | | 12/2004 | Schulze Beckinghausen |
| 2005/0076744 | A1 | | 4/2005 | Pietras et al. |
| 2005/0077743 | A1 | | 4/2005 | Pietras et al. |
| 2005/0092143 | A1 | | 5/2005 | Lehnert et al. |
| 2005/0188794 | A1 | | 9/2005 | Schulze-Beckinghausen |
| 2006/0179980 | A1 | | 8/2006 | Pietras et al. |
| 2007/0068669 | A1 | | 3/2007 | Lesko |
| 2007/0074606 | A1 | | 4/2007 | Halse |

FOREIGN PATENT DOCUMENTS

| | | |
|---|---|---|
| CA | 1062237 | 9/1979 |
| CA | 1164443 | 3/1984 |
| CA | 1185228 | 4/1985 |
| CA | 1194855 | 10/1985 |
| CA | 1195241 | 10/1985 |
| CA | 1250569 | 2/1989 |
| CA | 1254194 | 5/1989 |
| CA | 1257881 | 7/1989 |
| CA | 1265124 | 1/1990 |
| CA | 2018826 | 4/1991 |
| CA | 2048381 | 2/1993 |
| CA | 2113160 | 2/1993 |
| CA | 2113161 | 2/1993 |
| CA | 2131537 | 9/1993 |
| CA | 1327195 | 2/1994 |
| CA | 2148346 | 5/1994 |
| CA | 2115810 | 4/1995 |
| CA | 2195128 | 4/1995 |
| CA | 2224638 | 6/1999 |
| CA | 2325875 | 8/1999 |
| CA | 2306714 | 11/2000 |
| CA | 2389449 | 5/2001 |
| CA | 2390191 | 5/2001 |
| CA | 2451263 | 5/2004 |
| CA | 2484053 | 4/2005 |
| GB | 1470931 | 4/1977 |
| RU | 1834351 | 8/1996 |
| WO | WO 00/52297 | 9/2000 |
| WO | WO 01/51764 | 7/2001 |
| WO | WO 01/79652 | 10/2001 |
| WO | WO 2008/022424 | 2/2008 |
| WO | WO 2008/022427 | 2/2008 |
| WO | WO 2008/028302 | 3/2008 |
| WO | WO 2008/034262 | 3/2008 |

OTHER PUBLICATIONS

JAMPro™ Net, http://www.weatherford.com/weatherford/groups/public/documents/general/wft008926.pdf, 2005.

Drillfloor Equipment, http://www.akersolutions.com/Internet/IndustriesAndServices/OilAndGas/Drilling+Equipment/DrillfloorEquipment.htm, 2008.

Robot Roughneck Ready to Rule, http://www.akersolutions.com/Internet/MediaCentre/Featurestories/OilandGas/RobotRoughneckreadytorule.htm, 2008.

Mechanized Rig Systems, http://www.weatherford.com/weatherford/groups/public/documents/general/wft000668.pdf, 2001.

* cited by examiner

OILFIELD TUBULAR TORQUE WRENCH

CROSS-REFERENCE TO RELATED APPLICATION

This is a continuation application of co-pending PCT/CA2006/001388, filed Aug. 24, 2006, the contents of which is hereby incorporated herein in its entirety by express reference thereto.

FIELD

The present invention generally relates to oilfield tubular torque wrenches, which are sometimes termed power tongs or iron rough necks. These devices are used in handling make up or breakout of wellbore tubulars, such as drill pipe, stabilizers and bits.

BACKGROUND

Various types of torque wrenches have been employed when making up or breaking out drill pipe joints, drill collars, casing and the like in oilfield drilling and tubular running operations. Generally torque wrenches, which are sometimes also called power tongs or iron rough necks, include upper and lower tongs that sequentially grip and release upper and lower drill pipe joints with the upper and lower tongs being moved in a swiveling or scissoring manner to thread or unthread a threaded connection between the drill pipe joints. Power operated tongs have been provided for this purpose.

In some torque wrenches, an upper tong and a lower tong are swiveled with respect to each other by a torquing cylinder which can be extended or retracted to break out or make up the drill pipe as may be required. A pipe biting or gripping system on each tong utilizes moveable die heads that include pipe gripping dies. The die heads may be moveable by various means including, for example, hydraulic rams that extend to move the die heads into gripping or biting engagement with the pipe.

SUMMARY

In accordance with a broad aspect of the present invention, there is provided an oilfield tubular torque wrench comprising: a lower tong including a recess for accepting an oilfield tubular positioned along an axis passing through the recess; an upper tong including a recess, the upper tong being mounted above the lower tong with the recess of the upper tong positioned above the recess of the lower tong so that the axis passes therethrough; pipe gripping dies in the recesses of the upper tong and the lower tong, the pipe gripping dies being drivable between an extended position and a retracted position; a swivel bearing between the upper tong and the lower tong permitting the upper tong and the lower tong to swivel relative to each other while the recesses remain positioned with the axis passing therethrough; a drive system connected between the upper tong and the lower tong, the drive system being operable to generate a force vector to drive the upper tong and lower tong to swivel on the swivel bearing; and at least one of (i) a system to measure the actual radius measured perpendicularly to the force vector and between the force vector and the axis, and (ii) a system to measure the actual force vector being generated by the drive system.

In accordance with another broad aspect of the present invention, there is provided a method for measuring applied torque of a oilfield tubular torque wrench, the oilfield torque wrench being operable to torque a tubular about an axis of rotation and the oilfield torque wrench including a lower tong including a recess through which the axis of rotation passes during operation; an upper tong including a recess, the upper tong being mounted above the lower tong with the recess of the upper tong positioned above the recess of the lower tong so that the axis of rotation passes therethrough; pipe gripping dies in the recesses of the upper tong and the lower tong; a swivel bearing between the upper tong and the lower tong permitting the upper tong and the lower tong to swivel relative to each other while the recesses remain positioned with the axis of rotation passing therethrough; a drive system connected between the upper tong and the lower tong, the drive system being operable to generate a force vector to drive the upper tong and lower tong to swivel on the swivel bearing, the method comprising: determining at least one of (i) the actual radius measurement measured perpendicularly to the force vector and between the force vector and the axis of rotation of the tubular, and (ii) the actual force measurement of that force being applied to torque the connection; and calculating torque based on the at least one measurement.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF VARIOUS EMBODIMENTS

Figure 1A:
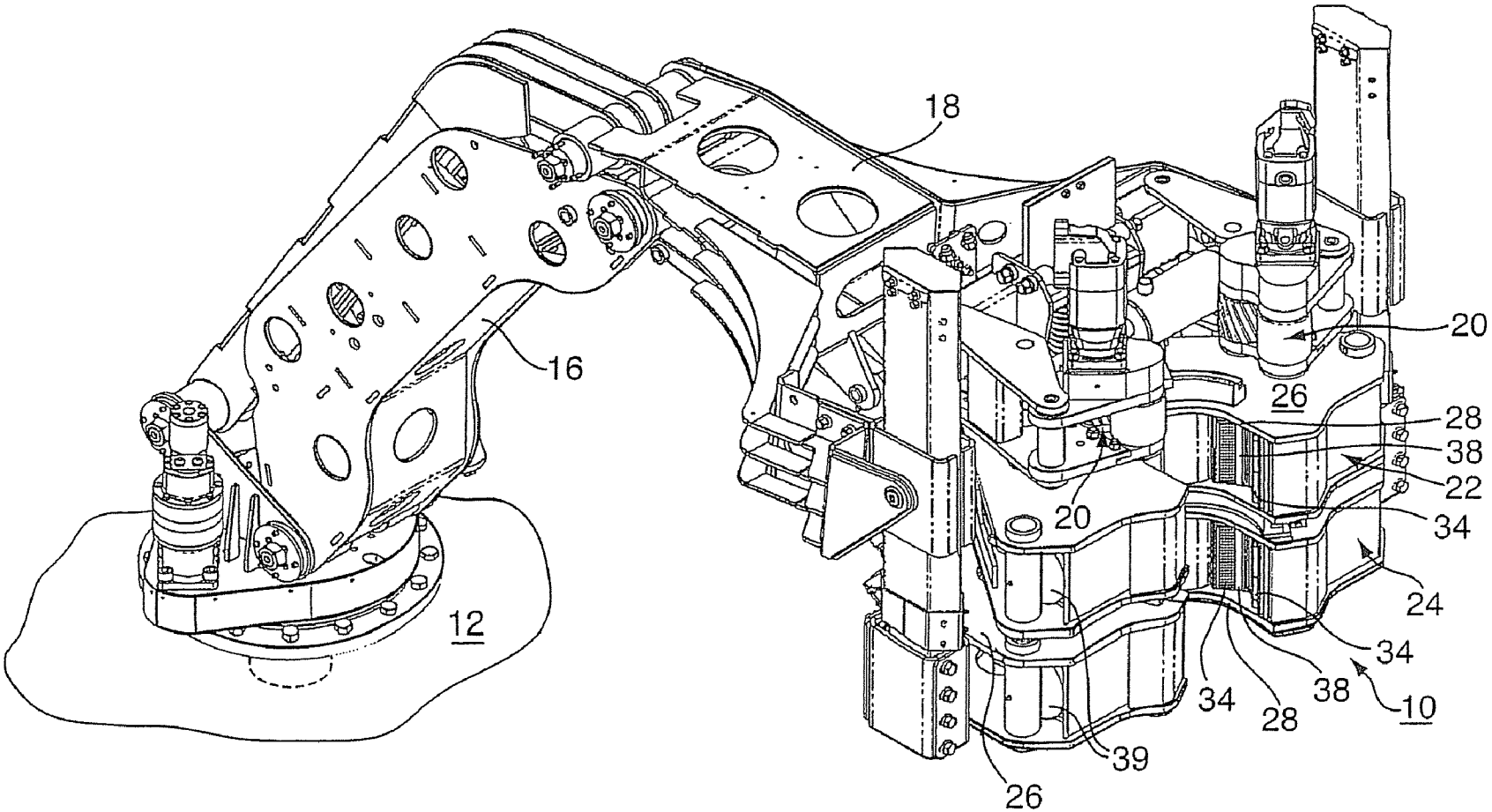
FIGS. 1A and 1B are perspective and top plan views, respectively, of a torque wrench mounted on a mounting structure.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention generally relates to drill pipe torque wrench tongs used in making up or breaking apart oilfield tubulars and includes dies for gripping a pipe to be handled.

To facilitate understanding of drill pipe torque wrenches, it is noted that such devices often include hydraulically or pneumatically powered upper and lower tongs that are swivelly connected for a scissoring action. Each of the tongs includes dies that act to bite into or grip a pipe to be handled.

Referring now specifically to FIGS. 1A to 2B of the drawings, one embodiment of a power actuated drill pipe torque wrench of the present invention is generally designated by numeral 10 and illustrated in association with a drill rig floor 12, a supporting member including in this embodiment an arm 16 which includes a laterally extending support member 18 for the wrench. The wrench is associated with a spinner generally designated by numeral 20, which is located above the wrench for spinning the pipe. While the invention is hereafter described utilizing hydraulically actuated power cylinders and a hydraulic circuit therefor, it will be readily appreciated and understood by those skilled in the art that any one or all of the power cylinders of this invention can alternately be pneumatic and a conventional pneumatic circuit may be used in conjunction therewith. Alternately, screw drives or other drivers may be used.

The tongs 10 include an upper tong 22 and a lower tong 24 each of which may be substantially identical and which each include a horizontally disposed body 26 with a recess 28 in an edge thereof to receive oilfield tubulars to be handled thereby including for example joints of drill pipe, drill collars, casing, wellbore liners, bits and the like.

In operation, upper tong 22 may act on an upper tubular 30 and lower tong 24 may act on a lower tubular 31. The tubulars 30, 31 are shown in phantom to facilitate illustration. With the upper tong 22 gripping an upper tubular and the lower tong gripping a lower tubular, tongs 22, 24 may be swiveled relative to each other, which often includes holding one of the tongs stationary, while the other tong swivels relative thereto, to either torque up or break out a threaded connection between the tubulars. Recesses 28 are formed so that tubulars 30, 31 extend generally along an axis x through the recesses and during swiveling of the tongs, the recesses remain positioned one above the other.

Each tong includes a plurality of pipe gripping dies 34 supported by body 26 in recess 28. The pipe gripping dies include pipe-gripping teeth mounted thereon. In the illustrated embodiment, dies 34 are mounted on die heads 38 that are moveable, as by hydraulics 39, pneumatics, screw drives, etc., toward and away from axis x. As such, dies 34 may be extended into a gripping position in recess 28 or retracted from a gripping position, as desired. In the illustrated embodiment, the die heads are positioned in recess 28 to act substantially diametrically opposite each other to act to grip a tubular therebetween.

Each die head 38 may have an angular or curved surface on which its dies 34 are mounted in spaced apart relation so that the dies are arranged along an arcuate path to generally follow the outer surface of a tubular 30 to be gripped, the outer surface, of course, also being generally arcuate. The spaced, angular positioning may enable the dies 34 to engage spaced points on the circumference of the tubular.

Figure 1B:
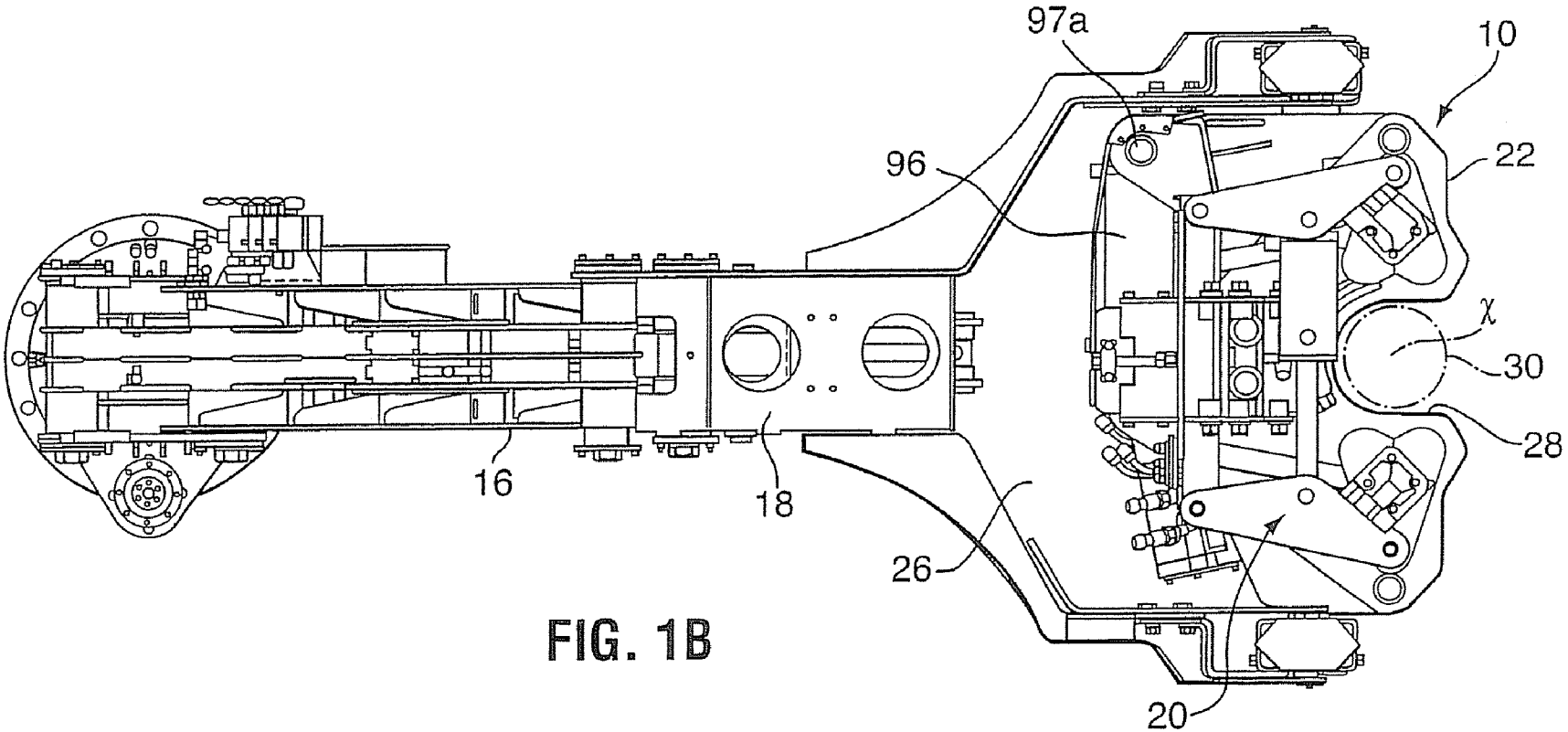
Figure 2A:
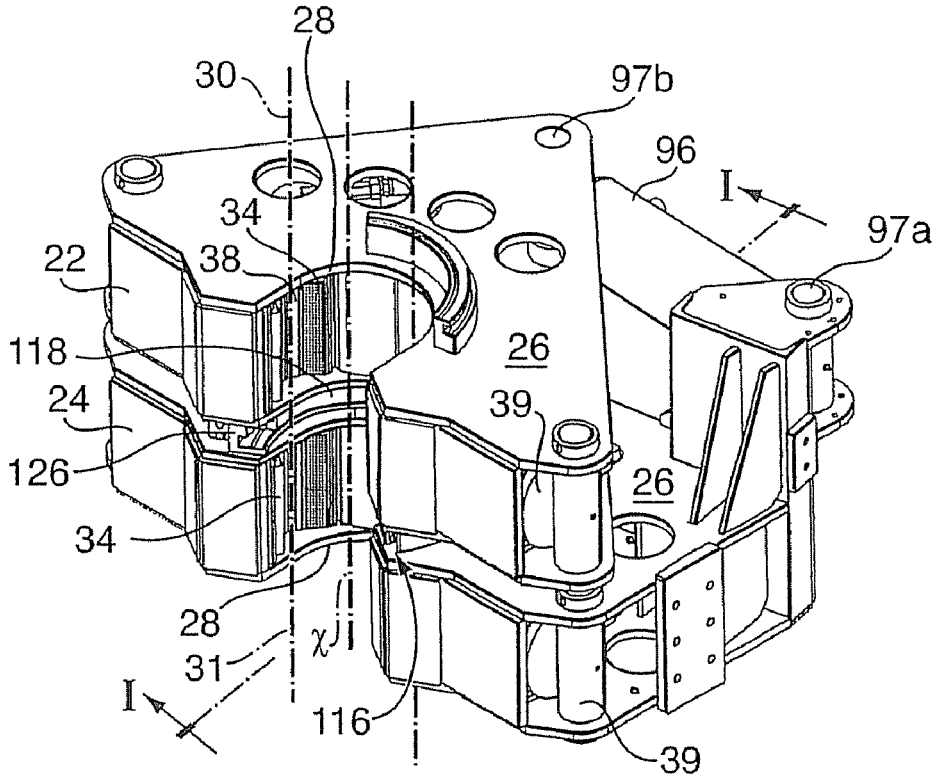
FIGS. 2A and 2B are perspective views of a torque wrench according to one embodiment of the invention with FIG. 2A showing the torque wrench tongs in a neutral position and FIG. 2B showing the torque wrench tongs in a connection torque up (make up) start position.
Figure 2B:
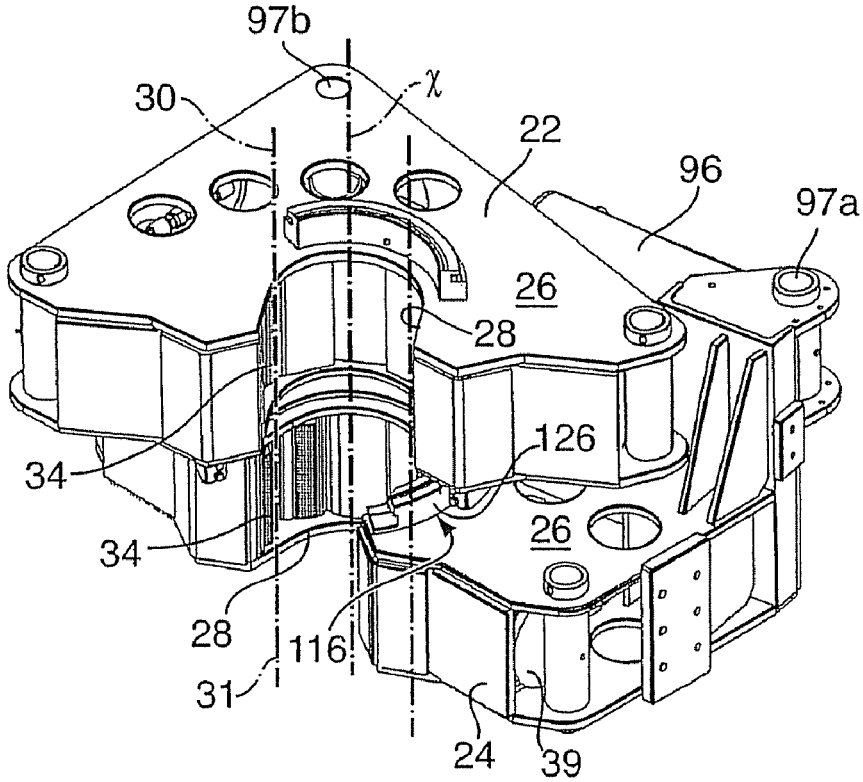

The upper tong 22 may swivel in relation to the lower tong 24 to move the tongs from a neutral position shown in FIGS. 1 and 2A to one of a make up torquing position or a break out torquing position. A make up torquing start position is illustrated in FIG. 2B. To permit the swiveling action, a retractable and extendable linear drive system may be pivotally connected between the upper tong and the lower tong. In the illustrated embodiment, the linear drive system includes double acting hydraulic piston and cylinder assembly 96 provided adjacent the end of the tong bodies 26 remote from the die heads 38. Cylinder assembly 96 is attached at its first end to lower tong 24 through a pivot pin 97*a* and bearing assembly and at its opposite end to upper tong 22 through pivot pin 97*b* and bearing assembly. Cylinder assembly 96 interconnects the upper and lower tongs 22 and 24 so that by extending and retracting the torquing piston and cylinder assembly 96 in timed relation to extension and retraction of the die heads, the upper and lower tubulars 30 and 31 may be gripped and torqued in a manner to make-up or break apart a threaded connection therebetween.

Extension and retraction of the piston and cylinder assembly 96 will cause the upper and lower tongs 22 and 24 to move toward and away from the torquing position illustrated in FIG. 2B and into or through the neutral position shown in FIG. 2A. That is, with the upper tong 22 either in alignment with the lower tong 24 or the upper tong 22 moved into angular position with respect to the lower tong 24 which is the torquing position illustrated in FIG. 2B, the tongs 22 and 24 are moved in a swiveling manner and after gripping an upper tubular and a lower tubular by use of dies, the tubulars may be rotated in relation to each other.

The upper and lower tongs 22 and 24 may be swivelly interconnected by a swivel bearing. In one embodiment, for example the swivel bearing includes a bearing ring assembly 116. Bearing ring assembly 116 may include a first partial ring 118 and a second partial ring 126 spaced outwardly of the recess 28 so that there will be no interference with movement of tubulars through the tongs. In this illustrated embodiment, the first partial ring 118 is secured to body 26 of the upper tong and the second partial ring 126 is secured to the lower tong 24. Rings 118 and 126 are formed to interlock at interfacing surfaces thereof to provide a swiveling bearing on which the upper tong and lower tong can pivot relative to each other. The interfacing surfaces between the rings bear the forces between the tongs and swivelly orient the upper and lower tongs 22 and 24 so that they will pivot about axis x during their relative pivotal movement.

When the tongs are properly aligned with oilfield tubulars 30, 31 to be handled, a threaded connection therebetween is positioned between the dies 34 of upper tong 22 and dies 34 of lower tong 24 and the tubulars extend generally along axis x. In that position, die heads 38 of lower tong 24 may be actuated to grip therebetween lower tubular 31. Then, depending upon whether the threaded connection is being made up or broken apart, the torque piston and cylinder assembly 96 is extended or retracted. During the extension or retraction of the torque cylinder, the die heads 38 on the upper tong 22 will be in their retracted positions so that the upper tong 22 can rotate in relation to the upper tubular 40. Thus, with the upper tong 22 released and the torque piston and cylinder assembly 96 either extended or retracted to an initial position depending upon whether the drill pipe is being made up or broken out, the upper tong 22 may then be brought into gripping engagement with the upper tubular 30 by moving the die heads out to place the dies carried thereon into gripping relation with the tubular. After this has occurred, both the upper tubular 30 and the lower tubular 31 are securely gripped by the respective tongs. Then, the piston and cylinder assembly 96 may be actuated for moving the upper and lower tongs 22 and 24 pivotally or swivelly in relation to each other thus torquing the drill pipe joints 30 and 31 either in a clockwise manner or a counterclockwise manner depending upon whether the threaded connection between the tubulars is being made up or broken out.

Figure 3A:
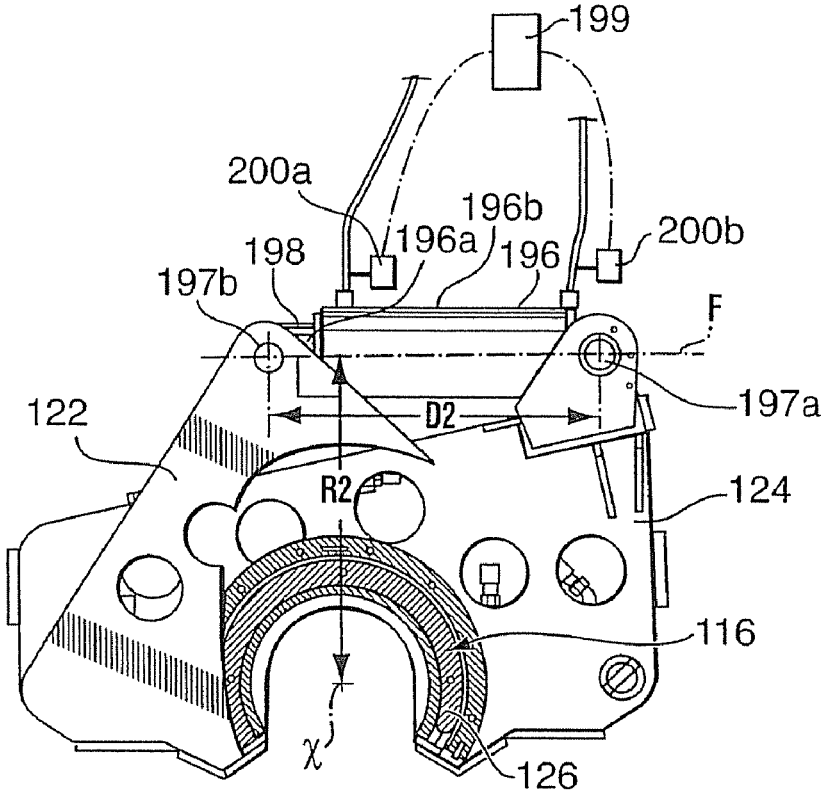
FIGS. 3A and 3B are schematic views of a linear drive system useful in the present invention with FIG. 3A showing the torque wrench tongs in a neutral position and FIG. 3B showing the torque wrench tongs in a torque up start position.

When handling oilfield tubulars it may be desirable to determine the torque being applied during make up or break out. Although a rough torque calculation may be acceptable in some situations, it may be necessary or desirable in other situations to determine the actual applied torque. In a torque wrench of the type described hereinabove, torque is applied through the action of a linear drive between the upper tong and the lower tong. Torque is calculated as the product of the force vector multiplied by radius, which is the distance from the point of applied force to the axis of rotation generated. As such, in one embodiment and with reference to FIGS. 3A and 3B, torque applied by the torque wrench may be calculated by first determining one or both of (i) the actual radius measured perpendicularly to the force vector, which in the illustrated embodiment is the drive axis F of the linear drive, and between the drive axis F of the linear drive creating the force and the axis x, which is the center of rotation of the tubular, or (ii) the actual force being applied to torque the connection with consideration to dynamic operational conditions, as may, for example, in the illustrated be produced by the linear drive. Such measurements may be made at one or more selected times during operation of the torque wrench. In one embodiment, a torque wrench monitoring/control system may repeatedly sample for either or both of the actual radius or the actual force during operation so that such measurements may be used to determine torque. Repeated samplings may be in the order of seconds or possibly milliseconds or even more frequent if such ongoing measurement is of interest. A monitoring/control system may accept and handle the measurements and control operation of the torque wrench thereon.

Figure 3B:
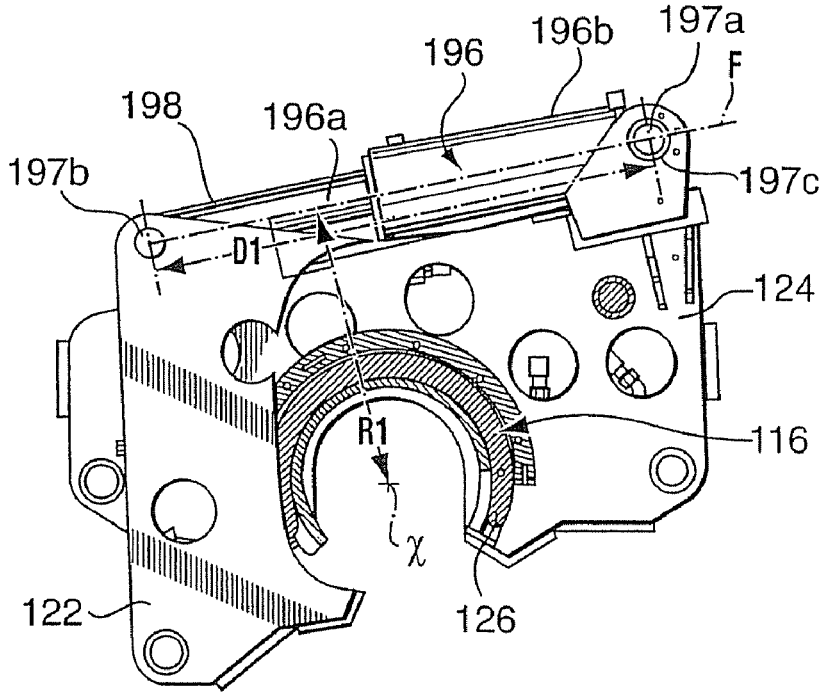

In the illustrated embodiment, the linear drive is shown as cylinder 196 connected to lower tong 124 by a pivotal connection 197*a* and connected to the upper tong by a pivotal connection 197*b*. In order to determine the actual radius perpendicular from the force vector, drive axis F, to axis x, consideration may be given to the fact that the radius changes as the cylinder is stroked to extend and retract. For example in the illustrated embodiment, the radius R1 between the drive axis F and axis x in the connection make up start position of FIG. 3B is less than the radius R2 between the drive axis F and axis x when the upper tong and lower tong are in the neutral position, shown in FIG. 3A. Various devices and processes may be used to determine the actual radius between the drive axis F and axis x which may include actual measurement of the radius, as by knowing the position of well center and a sensor to determine the force vector position. Alternately, actual radius may be derived by other wrench parameters. For example, it is noted that the radius between the drive axis F and axis x varies with the stroke length of the cylinder. In particular, as the cylinder rod 196*a* extends or retracts relative to the cylinder's piston housing 196*b*, the cylinder pivots about its pivotal mounts 197*a*, 197*b* to the upper tong and the lower tong, respectively, and this causes the cylinder drive axis to move relative to the axis x. Thus, as the cylinder strokes, the distance from the cylinder axis F to the center of the tubular, axis x, also changes. If it is desirable to determine the actual radius, during operation, it may be desirable to determine the radius measurements that correlate with various or all stroke positions of torque wrench cylinder 196. Thereafter, the length of the cylinder may be monitored to thereby determine the actual radius. The stroke length of the cylinder may be determined on a one time basis or on an ongoing basis during operation by use of any of various stroke length measuring devices 198, such as for example, those permitting real-time measurement, as by use of a linear transducer, magnetostrictive sensors, variable reluctance or a laser or sonic wave measuring device for the cylinder. Once the correlating stroke length and radius measurements have been made for a torque wrench configuration/geometry, they should not change during operation. Thus, such measurements may be stored in an automated system for use in torque measurements. In one embodiment, for example, an equation relating stroke length to actual radius can be formulated. At any particular time or substantially continuously, when a torque determination is of interest, the actual length of the drive may be determined and used with force to calculate torque.

True force may be determined by consideration of, for example factoring in, dynamic parameters of torque operation, including for example back pressure resistance, etc. When considering a determination of the actual force being applied by the linear drive, various force determining systems 199 may be used with cylinder 196. In one embodiment, a force determining system including at least one pressure transducer and which factors in one or more of back pressure and pressure drop in the hydraulic system, may be used to measure force on an ongoing basis. In one embodiment, for example, a system may be used which measures differential pressure across the piston and thereby applied force and which may include, for example, a pressure transducer 200*a* mounted close to the cylinder in pressure sensing communication with the hydraulic line to the rod-side chamber and a pressure transducer 200*b* on the hydraulic line to the piston face-side chamber. In another embodiment, a system may be employed to measure strain across the cylinder, for example, including a strain gauge 197*c* mounted on a pivotal connection 197*a* or 197*b*, which may for example measure force on the basis of deflection. In yet another embodiment, a load cell type pressure transducer may be used against which the cylinder is positioned to act. The force may be measured in real time continuously or at one or more selected times, as desired during a torquing operation and such force measurement may be used to calculate torque.

A torque calculation based on one or both of (i) the actual radius and (ii) the actual force may enhance connection make up and break out operations and may be useful in operational data logging and system monitoring. Of course for accuracy, it may be useful to calculate torque on the basis of both the actual radius and the actual force at any particular time during a torquing operation.

Since actual torque is generally of interest with respect to the amount of torque applied by the torque wrench to a pipe connection being torqued, it may be of interest to calculate the background torque required to operate the torque wrench, for example, the torque required to drive upper tong and lower tong to swivel relative to each other for example through bearing ring assembly 116. If the friction in bearing ring assembly 116 is measured, that friction generated torque requirement may be removed from the final torque calculation. It may alternately or in addition be desirable to select a low friction arrangement for the bearing ring assembly in order to reduce as much as possible the torque required to drive the swivelling of upper tong relative to lower tong.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. An oilfield tubular torque wrench comprising:

a lower tong including a recess for accepting an oilfield tubular positioned along an axis passing through the recess;

an upper tong including a recess, the upper tong being mounted above the lower tong with the recess of the upper tong positioned above the recess of the lower tong so that the axis passes therethrough;

pipe gripping dies in the recesses of the upper tong and the lower tong, the pipe gripping dies being drivable between an extended position and a retracted position;

a swivel bearing comprising a bearing ring assembly between the upper tong and the lower tong permitting the upper tong and the lower tong to swivel relative to each other while the recesses remain positioned with the axis passing therethrough;

a drive system connected between the upper tong and the lower tong, the drive system configured to generate a force vector to drive the upper tong and lower tong to swivel on the swivel bearing; and at least one of (i) a system to measure the actual radius measured perpendicularly to the force vector and between the force vector and the axis, and (ii) a system to measure the actual force vector being generated by the drive system when operational conditions are considered.

2. The oilfield tubular torque wrench of claim 1, wherein the drive system is a linear drive system and the system to measure the actual radius includes a linear drive length measuring device operable to measure a drive length between the upper tong and the lower tong during operation of the torque wrench.

3. The oilfield tubular torque wrench of claim 1, wherein the drive system is a hydraulic drive system including a hydraulic cylinder with a piston and the system to measure the actual force factors in back pressure of the hydraulic drive system.

4. The oilfield tubular torque wrench of claim 1, wherein the drive system is a hydraulic drive system including a hydraulic cylinder with a piston and the system to measure the actual force factors in pressure drop of the hydraulic drive system during operation.

5. The oilfield tubular torque wrench of claim 1, wherein the drive system is a linear drive system including a hydraulic cylinder with a piston and the system to measure the actual force includes a system to measure the differential hydraulic pressure across the piston.

6. The oilfield tubular torque wrench of claim 1 wherein the system to measure the actual force includes a strain gauge in communication with the drive system.

7. The oilfield tubular torque wrench of claim 1 comprising both a system to measure the actual radius and a system to measure the actual force vector.

8. A method for measuring applied torque of a oilfield tubular torque wrench, the oilfield torque wrench configured to torque a tubular about an axis of rotation and the oilfield torque wrench including a lower tong including a recess through which the axis of rotation passes during operation; an upper tong including a recess, the upper tong being mounted above the lower tong with the recess of the upper tong positioned above the recess of the lower tong so that the axis of rotation passes therethrough; pipe gripping dies in the recesses of the upper tong and the lower tong; a swivel bearing comprising a bearing ring assembly between the upper tong and the lower tong permitting the upper tong and the lower tong to swivel relative to each other while the recesses remain positioned with the axis of rotation passing therethrough; a drive system connected between the upper tong and the lower tong, the drive system being operable to generate a force vector to drive the upper tong and lower tong to swivel on the swivel bearing, the method comprising:

determining at least one of (i) the actual radius measurement measured perpendicularly to the force vector and between the force vector and the axis of rotation of the tubular, and (ii) the actual force measurement of that force being applied to torque the connection when operational conditions are considered; and calculating torque based on the at least one measurement.

9. The method of claim 8, wherein the actual radius measurement is measured by obtaining data correlating a linear drive length with radius measurements; measuring an actual linear drive length during operation of the torque wrench; using the actual linear drive length to extrapolate an actual radius measurement from the data; and wherein the step of calculating the applied torque is based on the radius measurement.

10. The method of claim 8, wherein the drive system is a hydraulic drive system including a hydraulic cylinder with a piston and the step of measuring actual force factors in back pressure of the hydraulic drive system.

11. The method of claim 8, wherein the drive system is a hydraulic drive system including a hydraulic cylinder with a piston and the step of measuring actual force factors in pressure drop of the hydraulic drive system during operation.

12. The method of claim 8, wherein the drive system is a linear drive system including a hydraulic cylinder with a piston and the step of measuring actual force includes measuring the differential hydraulic pressure across the piston.

13. The method of claim 8, wherein the step of measuring actual force monitors a strain gauge in communication with the drive system.

14. The method of claim 8, which comprises determining both the actual radius and the actual torque.

15. The method of claim 8, which further comprises determining a friction generated torque requirement of the swivel bearing and removing the friction generated torque requirement from a calculated torque.

16. The method of claim 8, which further comprises controlling the operation of the torque wrench based on a calculated torque.

17. A method for measuring applied torque of an oilfield tubular torque wrench having upper and lower pivoting zones, which method comprises:

associating the upper and lower pivoting zones about a bearing zone disposed therebetween so that the upper and lower pivoting zones swivel relative to each other, while a gripping portion in each pivoting zone is positioned to surround an axis of rotation of an oilfield tubular passing therethrough and adapted to connect with the tubular;

generating a force vector to drive the upper and lower pivoting zones to swivel about the bearing zone, determining at least one of (i) an actual radius measurement measured perpendicularly to a force vector and between a force vector and the axis of rotation of the tubular, and (ii) an actual force measurement of that force being applied to torque the connection; and calculating torque based on the at least one measurement.

18. The method of claim 17, wherein the bearing zone is disposed equidistant from the upper and lower pivoting zones.

19. The method of claim 17, which further comprises determining a friction generated torque requirement of the bearing zone and removing the friction generated torque requirement from the calculated torque.

* * * * *